US012158067B2

(12) United States Patent
Kolbe et al.

(10) Patent No.: US 12,158,067 B2
(45) Date of Patent: Dec. 3, 2024

(54) ESTIMATING WELLBORE CURVATURE USING PAD DISPLACEMENT MEASUREMENTS

(71) Applicant: Schlumberger Technology Corporation, Sugar Land, TX (US)

(72) Inventors: Stuart Alan Kolbe, Stonehouse (GB); Denis Li, Houston, TX (US); Geoffrey Charles Downton, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 398 days.

(21) Appl. No.: 17/655,232

(22) Filed: Mar. 17, 2022

(65) Prior Publication Data

US 2022/0298910 A1 Sep. 22, 2022

Related U.S. Application Data

(60) Provisional application No. 63/162,575, filed on Mar. 18, 2021.

(51) Int. Cl.

| | |
|---|---|
| ***E21B 44/02*** | (2006.01) |
| ***E21B 7/06*** | (2006.01) |
| ***E21B 47/022*** | (2012.01) |

(52) U.S. Cl.
CPC ..... *E21B 44/02* (2013.01); *E21B 7/06* (2013.01); *E21B 47/022* (2013.01)

(58) Field of Classification Search
CPC ..... E21B 44/02; E21B 7/06; E21B 47/022
See application file for complete search history.

(56) References Cited

U.S. PATENT DOCUMENTS

| | | | | |
|---|---|---|---|---|
| 9,272,337 | B2 * | 3/2016 | Steppan | B23B 35/00 |
| 2015/0247399 | A1 * | 9/2015 | Doelalikar | E21B 12/02 175/48 |
| 2015/0369030 | A1 * | 12/2015 | Hay | E21B 21/08 700/275 |
| 2017/0370152 | A1 * | 12/2017 | Samuel | E21B 47/12 |
| 2022/0003043 | A1 * | 1/2022 | Nanayakkara | E21B 7/10 |

FOREIGN PATENT DOCUMENTS

WO 2021126639 A1 6/2021

* cited by examiner

*Primary Examiner* — Thomas C Lee
*Assistant Examiner* — Tyler Dean Hedrick

(57) ABSTRACT

A method for evaluating a subterranean wellbore includes rotating a drill string in the subterranean wellbore. The drill string includes a rotary steerable tool, a steerable drill bit, or other rotary steering tool with at least one pad configured to extend radially outward from a tool body and engage a wall of the wellbore. Radial displacements of the pad are measured while rotating and processed to compute a curvature of the wellbore.

18 Claims, 8 Drawing Sheets

ESTIMATING WELLBORE CURVATURE USING PAD DISPLACEMENT MEASUREMENTS

CROSS REFERENCE TO RELATED APPLICATIONS

This application claims the benefit of, and priority to, U.S. Patent Application No. 63/162,757, filed Mar. 18, 2021, and titled "Estimating Wellbore Curvature using Pad Displacement Measurements", which application is expressly incorporated herein by this reference in its entirety.

BACKGROUND

Semi-automated steering methods for drilling a portion of a subterranean wellbore or holding a predetermined inclination and/or azimuth are well known. In recent years there has been a keen interest in developing fully automated, closed loop drilling methods that don't require surface intervention. One difficulty in developing such methods has been making continuous (e.g., real-time or instantaneous) measurements of various drilling metrics such as rate of penetration of drilling, wellbore attitude (e.g., inclination and azimuth), and wellbore curvature while drilling.

Moreover, in order to minimize latency (and provide timely feedback) it is desirable to make such borehole measurements as close to the bit as possible. Those of skill in the art will appreciate that reducing the distance between the sensors and the bit reduces the time between drilling (cutting the formation) and measuring the borehole properties and thereby provides more timely feedback.

However, sensor deployment at or near the drill bit is often not feasible. The lower portion of the bottomhole assembly ("BHA") tends to be particularly crowded with essential drilling and steering tools, e.g., often including the drill bit, a steering tool, and a near-bit stabilizer. While at bit and/or near bit deployment of sensors is known, such deployments can compromise the integrity of the lower BHA. Notwithstanding, there remains a need for methods and systems for making at-bit and/or near-bit borehole measurements and for obtaining information about the wellbore as soon as possible after drilling, for example, to support the development of automated drilling routines.

SUMMARY

A method for measuring curvature of a subterranean wellbore is disclosed. The method includes rotating a drill string in the subterranean wellbore. The drill string includes a rotary steerable tool or a steerable drill bit including at least one pad configured to extend radially outward from a tool body and engage a wall of the wellbore. Radial displacements of the pad are measured while rotating (e.g., drilling). The measured radial displacements are processed to compute a curvature of the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and aspects thereof, reference is now made to the following descriptions taken in conjunction with the accompanying drawings, in which:

FIG. 4-1 and FIG. 4-2 (collectively FIG. 4) are cross-sectional views of an example steering piston in extended (FIG. 4-1) and retracted (FIG. 4-2) positions, according to embodiments of the present disclosure.

FIG. 6-1 and FIG. 6-2 (collectively FIG. 6) are cross-sectional schematic views of a steering tool or steerable drill bit deployed in wellbore, according to embodiments of the present disclosure.

For simplicity, some reference numbers are repeated to denote similar features or components, but it will be understood that such features are not required to be implemented in each embodiment the same way, and that features may be combined or substituted as would be appreciated by one skilled in the art.

DETAILED DESCRIPTION

Disclosed embodiments relate generally to rotary drilling methods, to directional drilling methods, and more particularly to methods for making wellbore curvature measurements using pad displacement measurements while drilling.

Example methods for measuring wellbore curvature are disclosed. Optionally, the methods occur while performing a downhole operation such as drilling, reaming, milling (collectively "drilling"), perforating, running casing, or performing other downhole operations. According to one embodiment, a method includes rotating a drill string in the subterranean wellbore. The drill string may include a drill collar, a drill bit, and a rotary steerable tool. The rotary steerable tool is configured to rotate with the drill string or in response to rotation of a downhole motor, and includes at least one pad configured to extend and retract outwardly and inwardly relative to the body of the rotary steerable tool, and thereby control the direction of drilling. In an alternative embodiment the drill collar and/or rotary steerable tool may be integrated into a steerable drill bit including at least one pad configured to extend and retract and thereby control the direction of drilling. Radial displacement measurements of the pad (also referred to herein as pad extension measurements) made while rotating the steering tool (e.g., while drilling) may be processed to compute a curvature of the wellbore.

The disclosed embodiments may provide various technical advantages and improvements over the prior art. For example, the disclosed embodiments may provide an improved method and system for drilling a subterranean wellbore in which continuous wellbore curvature may be measured using pad extension measurements made on extendable and retractable pads deployed very close to or even in the drilling bit. For example, in certain embodiments, the pads may be deployed in a steerable drill bit or in a rotary steerable tool deployed immediately above the drill bit. The disclosed embodiments may further be utilized to enable closed loop control of drilling along a predefined well path or curved section of a wellbore.

Figure 1:
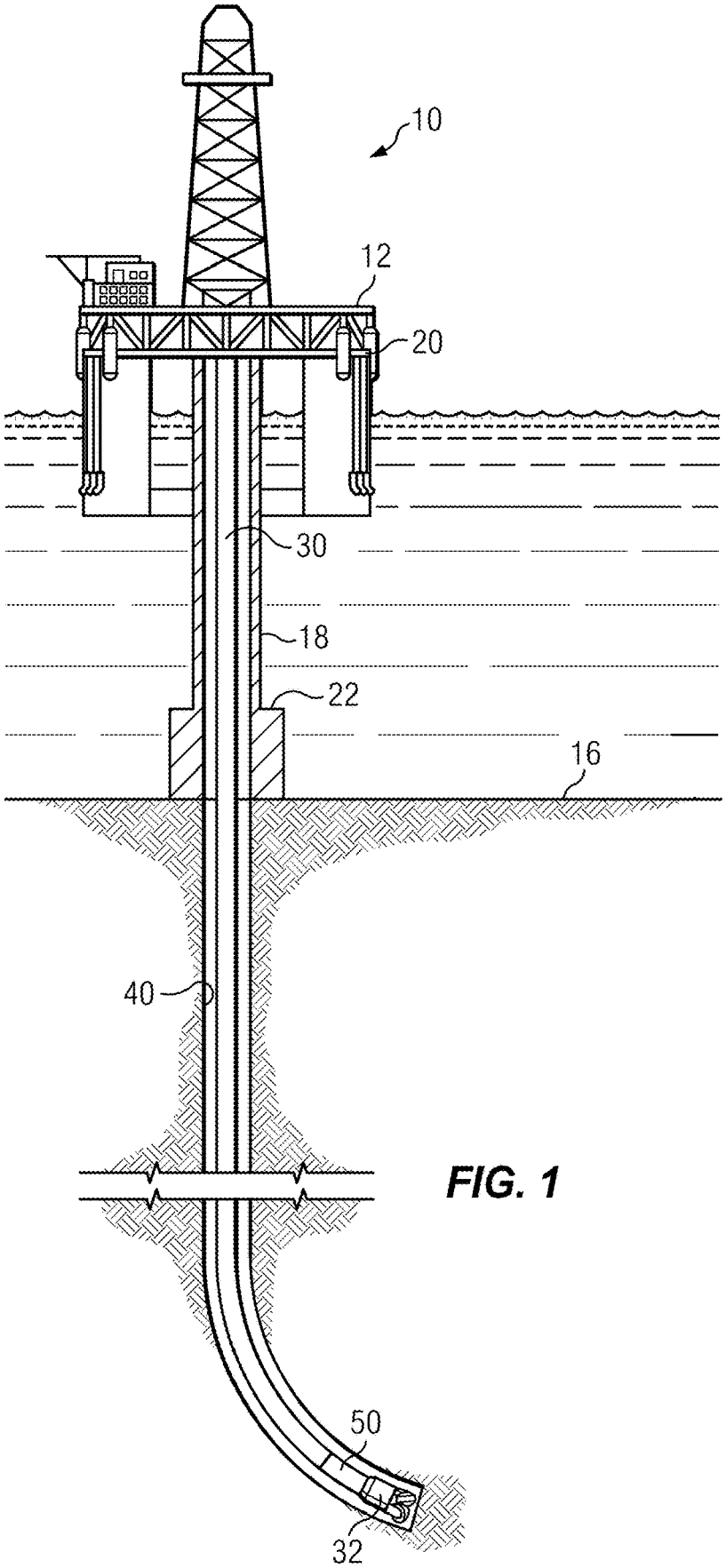
FIG. 1 is a schematic, cross-sectional view of a lower BHA portion of a drill string, in which embodiments of the present disclosure may be utilized.

FIG. 1 depicts a drilling rig 10 suitable for implementing various embodiments disclosed herein. In this illustrative embodiment, a semi-submersible drilling platform 12 is positioned over an oil or gas formation disposed below the sea floor 16. A subsea conduit 18 extends from deck 20 of the platform 12 to a wellhead installation 22. The platform 12 may include a derrick and a hoisting apparatus for raising and lowering a drill string 30, which, as shown, extends into wellbore 40 and includes a drill bit 32 and a rotary steerable tool 50. The drill string 30 may further include, by way of example, a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semi-submersible platform 12 as illustrated on FIG. 1. The disclosed embodiments are equally well suited for use with any kind of subterranean drilling operation, either offshore or onshore.

Figure 2:
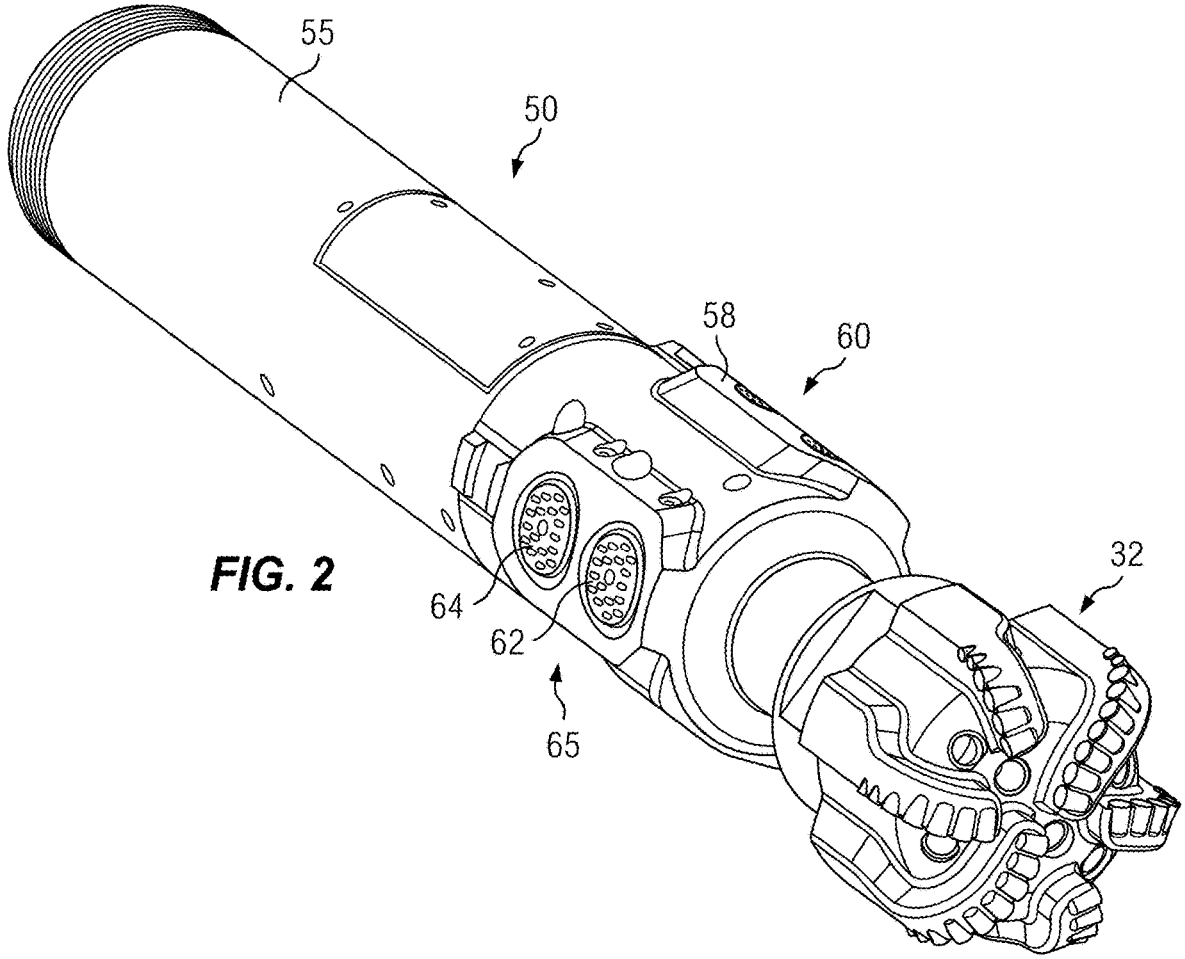
FIG. 2 is a perspective view of a steering tool of a BHA, according to some embodiments of the present disclosure

FIG. 2 depicts a portion of a BHA that may be used in a drilling system. For instance, the portion may be a lower portion of a BHA of the drill string 30, and can include a drill bit 32 and rotary steerable tool 50. It will be understood that while not depicted in FIG. 2, the drill bit 32 and rotary steerable tool 50 may be integrated into a steerable drill bit (see FIG. 3). For the purposes of this disclosure, such embodiments may be thought of as being essentially identical and are referred to interchangeably as a rotary steerable tool and a steerable drill bit.

The embodiments of this disclosure may make use of substantially any rotary steerable tool (i) in which the steering is actuated by the radial extension and retraction of pads (or blades or pistons), for example, outwardly and inwardly from the tool collar, (ii) in which the tool collar rotates with the drill string or a lower portion of a drill string driven by a downhole motor, and (iii) in which at least one of the pads is instrumented for measuring pad extension. For example, the disclosed embodiments may utilize NEO-STEER® at-bit steerable systems (available from Schlumberger). The disclosed embodiments may also make use of properly configured POWERDRIVE® rotary steerable systems (available from Schlumberger) such as the POWERDRIVE® X5, X6, and Orbit rotary steerable systems. Certain of the disclosed embodiments may also be implemented on the POWERDRIVE ARCHER® rotary steerable systems, which makes use of a lower steering section joined at a swivel with an upper section. The swivel is actively tilted via displacing internal pistons so as to change the angle of the lower section with respect to the upper section and maintain a desired drilling direction as the bottomhole assembly rotates in the wellbore.

With continued reference to FIG. 2, the example rotary steerable tool embodiment 50 includes a collar (tool body) 55 configured to rotate with at least a portion of the drill string (e.g., via connection to the drill string). The depicted tool includes a plurality of pads 60, at least one of which is configured to extend outwardly from the collar 55 into contact with the wellbore wall and thereby steer the downhole steering tool and the drill string. The pads 60 may be circumferentially spaced about the collar 55 and/or axially spaced along the collar 55

In the depicted embodiment, the tool includes three circumferentially spaced pad pairs 65 (e.g., spaced at 120 degree intervals about the tool circumference). Each pad pair 65 includes first and second axially spaced pads 62 and 64 deployed in/on a gauge surface 58 of the collar 55. Within a pad pair 65, the axially spaced pads 62 and 64 may be deployed in close axial proximity to one another and may be circumferentially aligned or offset, and may be the same or of different sizes. The use of closely spaced pads may improve accuracy and enable redundant wellbore curvature measurements as described in more detail herein. In certain rotary steerable tool embodiments, the pads 62 and 64 may have an axial spacing of less than 60 cm (e.g., less than 30 cm, less than 15 cm, less than 10 cm, less than 5 cm, or less than 3 cm), measured from the uphole-most portion of the downhole pad 62 and the downhole-most portion of the uphole pad 64. The axial spacing of pads 62 and 64 may also be defined with respect to the diameter of the gauge surface 58. For example, the axial spacing may be less than twice the diameter of the gauge surface (e.g., less than the diameter of the gauge surface, less than 0.7 times the diameter of the gauge surface, less than 0.5 times the diameter of the gauge surface, or less than 0.25 times the diameter of the gauge surface).

Figure 3:
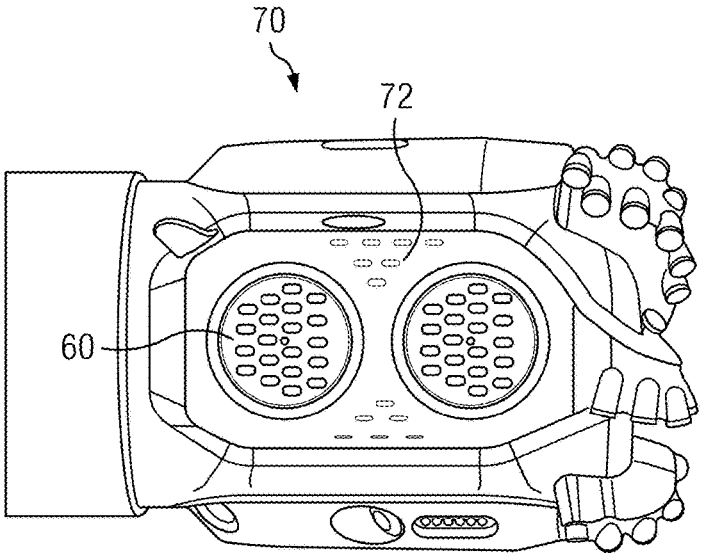
FIG. 3 is a side view of a steerable drill bit with which embodiments of the present disclosure may be utilized.

Turning now to FIG. 3, and as described herein, it will be understood that the disclosed embodiments are not limited to rotary drilling embodiments in which the drill bit 32 and rotary steerable tool 50 are distinct or separable tools (or tool components). FIG. 3 depicts a steerable drill bit 70 including a plurality of steering pads 60 deployed in the sidewall of the bit body 72 (e.g., on gauge pads or other gauge surfaces). The steerable bit 70 may be thought of as an integral drilling system in which the rotary steerable tool and the drill bit are integrated into a single tool body (e.g., a drill bit body) 72. The drill bit 70 may include substantially any suitable number of pads 60, for example, three pairs of circumferentially spaced pad pairs in which each pad pair includes first and second axially spaced pads including as described above with respect to FIG. 2. The disclosed embodiments are not limited in this regard.

With continued reference to FIGS. 2 and 3, it will be understood that the pads 60 may be deployed close to the cutting structure (e.g., cutting elements) of the drill bit. For example, the downhole pad 62 (i.e., the pad closest to the cutting elements or face of bit) may be deployed less than 5 meters (e.g., less than 3 m, less than 1.5 m, less than 1 m, less than 0.5 m, or less than 0.25 m) above the cutting structure of the drill bit 32, 70. In embodiments in which the pads are deployed in a steerable drill bit (such as drill bit 70 shown on FIG. 3), a downhole pad may be deployed less than 60 cm (e.g., less than 30 cm or less than 15 cm) above the cutting structure of the bit.

The deployment of the pads 60 may also be defined with respect to the diameter of the gauge surface 58. For example, the axial spacing between the downhole pad (e.g., pad 62 in FIG. 2) and the cutting structure of the bit may be less than 15 times the diameter of the gauge surface (e.g., less than 10 times the diameter of the gauge surface, less than about 8 times the diameter of the gauge surface, less than 5 times the diameter of the gauge surface, less than twice the diameter of the gauge surface, less than the diameter of the gauge surface, or less than 0.5 times the diameter of the gauge surface). In embodiments in which the pads are deployed in a steerable drill bit (such as drill bit 70 shown on FIG. 3), the axial spacing between the downhole pad and the cutting surface of the bit may be less than 5 times the diameter of the gauge surface (e.g., less than 3 times, less than 2 times the diameter of the gauge surface, less than the diameter of the gauge surface, less than 0.5 times the diameter of the gauge surface, or less than 0.25 times the diameter of the gauge surface).

Figures 1, 4:
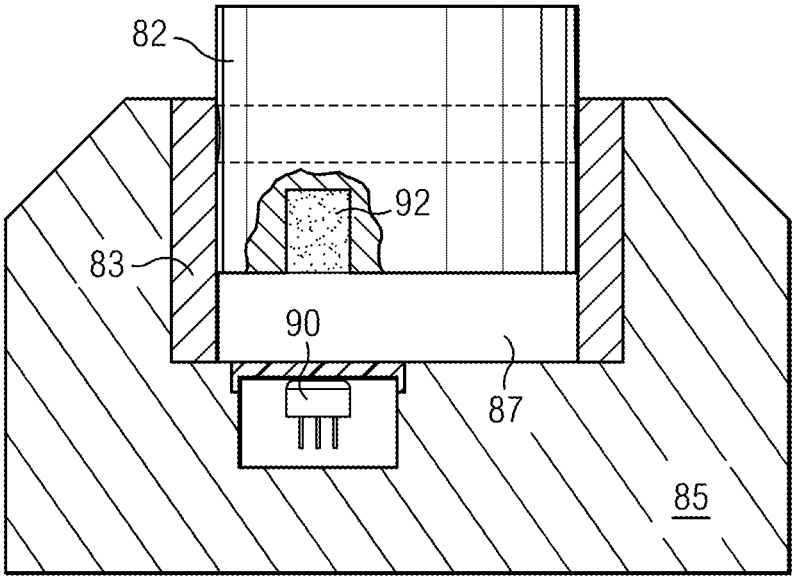
Figures 2, 4:
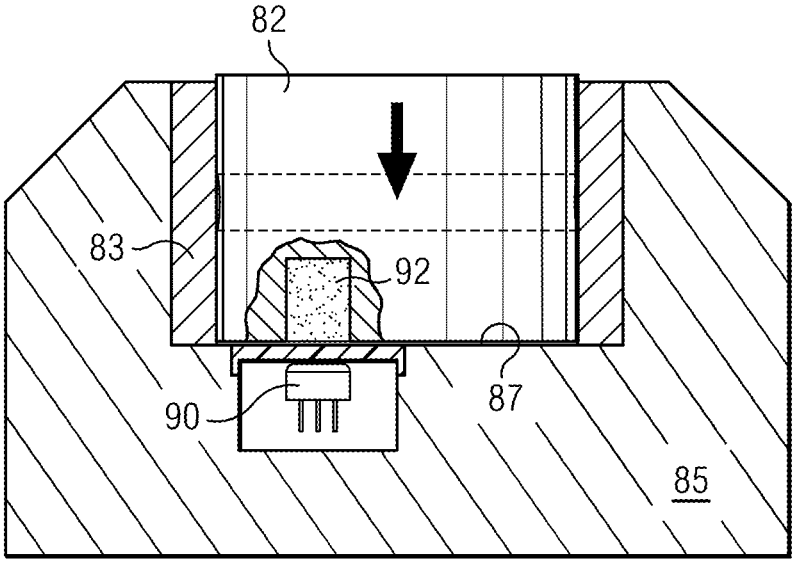

FIG. 4-1 and FIG. 4-2 (collectively FIG. 4) are cross-sectional views of one of pads 60 shown in fully extended (FIG. 4-1) and fully retracted (FIG. 4-2) positions. In the example embodiment shown, a piston 82 is deployed in a corresponding sleeve 83 in a bore within the pad housing 85. As noted herein, the piston 82 is configured to extend outwardly (as shown on FIG. 4-1) from the housing 85, for example, via porting drilling fluid to cavity 87 (which is located behind and radially interior to the piston 82). The piston may optionally be biased inwards, for example, via the use of a conventional spring mechanism (not shown) such that the piston 82 retracts when drilling fluid is diverted away from the cavity 87 (shown fully retracted in FIG. 4-2).

The pad assembly is optionally equipped with a sensor 90 configured to measure the extension (radial displacement) of the piston 82 (e.g., the outward extension of the pad from a fully retracted position). The sensor 90 may include a proximity sensor, such as a magnetic sensor configured to measure magnetic flux emanating from a magnet 92 deployed on the piston 82. For example, the magnetic sensor may include a Hall Effect sensor that measures the strength of the magnetic field emanating from magnet 92 and thereby computes the extension of the piston 82. Such sensors are known in the art.

As noted above, at least one of the pads can be instrumented such that that the radial displacement (extension) of the pad may be measured (quantified). By radial displacement it is meant the outward extension of the pad relative to a retracted position such as the fully retracted position. In some embodiments, first and second axially spaced pads are instrumented. In other embodiments, first and second circumferentially spaced pats are instrumented. In other embodiments, each of the circumferentially spaced pads and/or axially spaced pads are instrumented.

Figure 5:
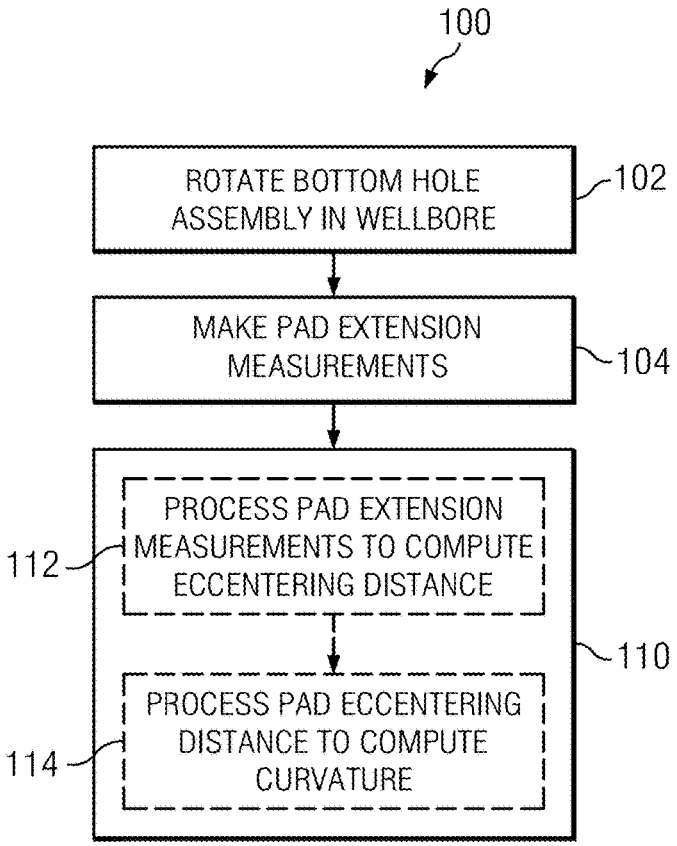
FIG. 5 is a flow chart of an example method for evaluating a curvature of a subterranean wellbore, according to embodiments of the present disclosure.

FIG. 5 depicts a flow chart of one example embodiment of a method 100 for drilling a subterranean wellbore. A bottomhole assembly (e.g., as depicted on FIGS. 1 and 2 or including a steerable drilling bit as depicted on FIG. 3) is rotated in the wellbore at 102. The BHA may be rotated while the drill bit is in contact with the bottom of the wellbore, for example, while drilling the wellbore. The BHA may alternatively be rotated while the drill bit is off bottom, e.g., for reaming or cleaning the wellbore or while taking a survey. The bottomhole assembly includes a steering tool or a steerable drill bit with at least one extendable pad (e.g., as described above with respect to FIGS. 2 and 3). Pad extension (radial displacement) measurements are made while drilling or performing another downhole operation (i.e., while rotating the bottomhole assembly in the wellbore) at 104 and are processed at 110 to compute a curvature of the wellbore. In one example embodiment, the processing at 110 may include processing the pad extension measurements at 112 to compute an eccentering distance between the center of the wellbore and the center of the tool and processing the eccentering distance at 114 to compute the curvature of the wellbore.

With continued reference to FIG. 5, the curvature may be computed, for example, using the following mathematical equation:

$$\frac{1}{R} = \frac{2 \cdot ecc}{L_1 \cdot L_2} \tag{1}$$

where R represents the radius of curvature of the wellbore, ecc represents the eccentering distance, $L_1$ represents an axial distance along a length of the drill string from the drill bit (e.g., a gauge surface on the bit or a cutting surface of the bit) to the pad (e.g., a leading or trailing edge of the pad or from the center of the pad), and $L_2$ represents an axial distance from the pad to the next contact point in the drill string uphole from the pad. It will be understood that selecting precise values for $L_1$ and $L_2$ may depend on the BHA configuration as well as the formation characteristics (e.g., to determine the precise location of the contact points on the bit and pad).

As used herein, the wellbore curvature or radius of curvature of a wellbore or wellbore section quantifies the severity or degree of the curve of the borehole as it penetrates the earth formations. Wellbore curvature is commonly referred to in the art as 'dogleg severity' ("DLS") and is sometimes expressed in units of degrees of attitude change per 100 feet of wellbore length (e.g., 6 degrees per 100 feet) or degrees of attitude change per 30 m of wellbore length (e.g., 6 degrees per 30 m). In some operations, the wellbore curvature may be defined by a build rate and/or a turn rate. Build rate commonly refers to vertical curvature (or the vertical component of curvature) and may be expressed as a change in inclination along the length of the wellbore. Turn rate commonly refers to horizontal curvature (or the horizontal component of curvature) and may be expressed as a change in azimuth along the length of the wellbore. It will be understood by those of ordinary skill that curved sections of a wellbore commonly include both vertical and horizontal components (changes in inclination and azimuth). Wellbore curvature may also be expressed as a DLS and a toolface angle, with the DLS indicating the magnitude of the curvature and the toolface angle representing the direction the wellbore is curving towards.

It will be appreciated that the disclosed embodiments may be thought of as making instantaneous curvature measurements. Instantaneous curvature refers to the local (or incremental) curvature of the wellbore and may be understood to be analogous to continuous curvature (or continuous curvature measurements). By continuous or instantaneous it is meant that the curvature measurements are made during the drilling or other downhole operation. For example only, the instantaneous curvature measurements may be made at intervals of 0.5 second (2 Hz), 1 second (1 Hz), 2 seconds (0.5 Hz), 3 seconds (0.3 Hz), 5 seconds (0.2 Hz), or 10 seconds (0.1 Hz) intervals, depending on the rate of penetration and the rotation rate of the drill string. At common rates of penetration during drilling, the instantaneous curvature measurements may therefore be made at depth intervals of about 0.5 to 5 inches (1.3 to 12.7 cm) or less.

In some embodiments, the continuous or instantaneous measurements may be made based on a drilling cycle that for a rotary steerable tool includes a single bias phase and a single neutral phase. For instance, 1, 2, 3, or more instantaneous curvature measurements can be made per drilling cycle. Thus, one or more measurements may be made during a drilling cycle of 30 seconds, 60 seconds, 120 seconds, 180 seconds, or other drilling cycles. Notably, the continuous or instantaneous measurements are in contrast to conventional static surveying measurements that are commonly made at 30 ft. (9.1 m) or 90 ft. (27.4 m) intervals when adding a new stand to the drill string.

It will be understood that a curved section of a wellbore does not generally curve smoothly, i.e., with the curvature being constant over the length of the section. On the contrary, the local curvature can sometimes increase and decrease along the length of the wellbore section (for numerous reasons including the drilling mode, steering ratio during drilling cycles, and the formation characteristics). A wellbore section has an average curvature define by the angular change in attitude over the length of the section (as described herein). However, the instantaneous (or local) curvature at any one point along the section may vary depending, for example, on the drilling hardware, the formation properties, the rate of penetration, and drilling dynamics.

With reference again to Equation 1, the radius of curvature may be converted to dogleg severity DLS in units of degrees per hundred foot length of wellbore, for example, as follows:

$$DLS = \frac{100}{R} \cdot \frac{180}{\pi} \tag{2}$$

where DLS represents the dogleg severity in units of degrees per 100 feet, R represents the radius of curvature in units of feet, and $180/\pi$ converts units of angular radians to degrees. Those of ordinary skill in the art will of course be able modify Equation 2 to convert units should R may be expressed in meters (or other metric or nonmetric units).

With continued reference to FIG. 5, in one example embodiment the bottomhole assembly includes three circumferentially spaced pads (e.g., as depicted on FIGS. 2 and 3). Pad extension measurements may be made using at least one of the pads in 104 while the tool rotates at 102. Corresponding magnetometer or other measurements may be made to determine a toolface angle of one of the pads. The toolface angle of the other pads may be determined from the known circumferential spacing. The pad extension measurements may be processed to compute the center of the wellbore, the center offset of the steering tool 50 or steerable bit 70, the wellbore diameter, and the wellbore shape using geometry and trigonometry principles known to those of ordinary skill in the art.

Figures 1, 6:
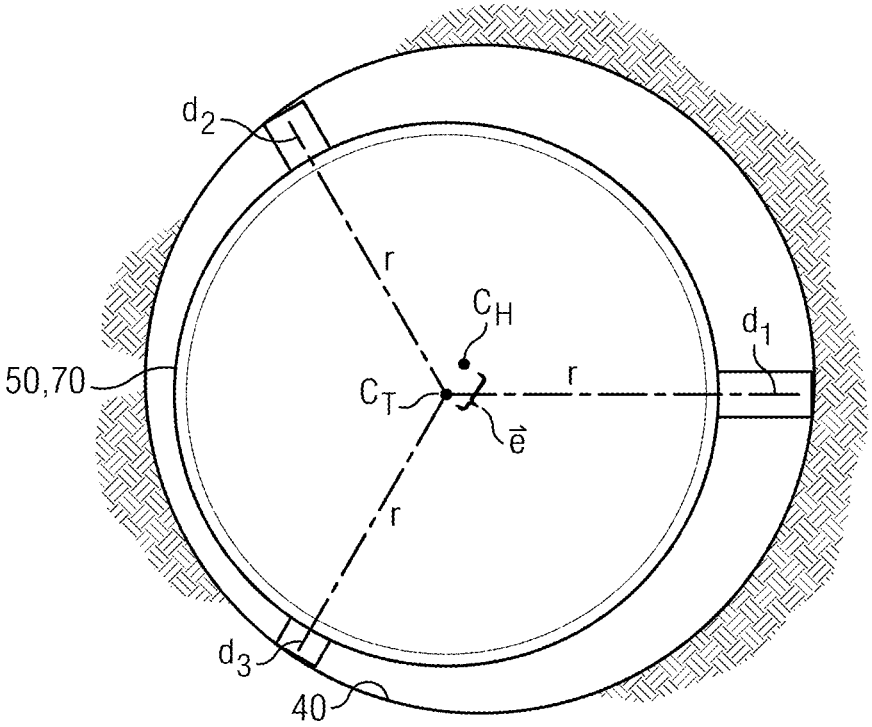
Figures 2, 6:
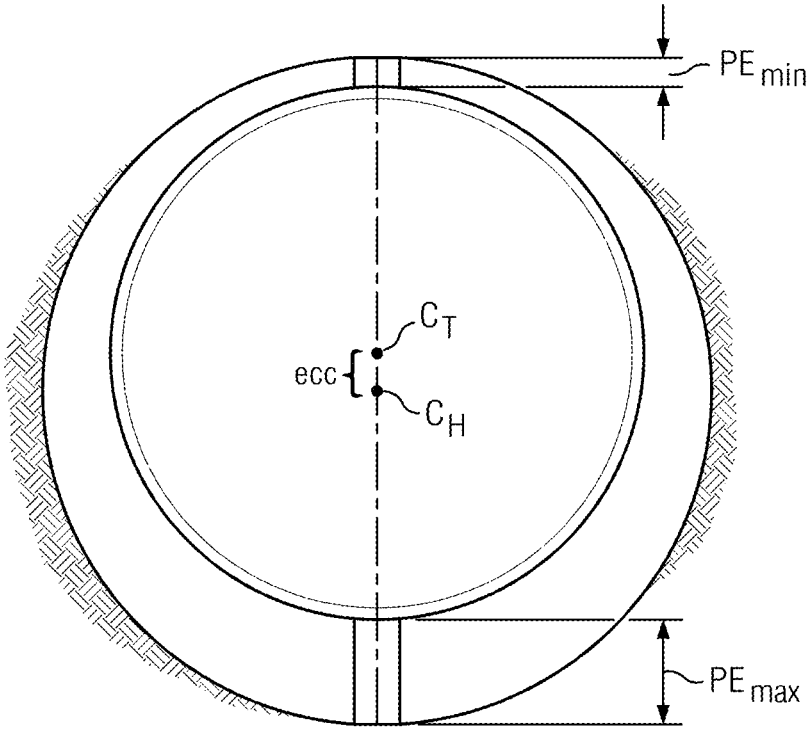

FIG. 6-1 is a cross-sectional schematic view of a steering tool 50 or steerable drill bit 70 deployed in a wellbore 40. In the depicted schematic, the center of the tool $C_T$ is offset from the center of the wellbore $C_H$ by eccentering vector $\vec{e}$ (the magnitude of which is the eccentering distance ecc). Circumferentially offset pads may be extended into contact with the wellbore wall at corresponding piston displacements of $d_1$, $d_2$, and $d_3$. For ease of illustration, each of the pads is shown in an extended position; however, it will be understood by one skilled in the art that pads may expand at different times, or sequentially, and that one or more, but fewer than all, pads can be expanded at some points in time.

The tool radius r may be defined for example in FIG. 6-1 as the distance from $C_T$ to the pad when the pad is retracted (e.g., fully retracted as shown in FIG. 6-2). In the tool reference frame (in which the center of the tool $C_T$ is located at (0,0)), the extended pads are located distances $r+d_1$, $r+d_2$, and $r+d_3$ from $C_T$. It will be understood that the extended pads represent three distinct points along the circumference of the wellbore (at any instant in time). Rotation of the tool and subsequent pad extension measurements generate additional points. Assuming that the wellbore has a circular cross-section, these points may be processed to determine the center of the wellbore $C_H$ in the tool coordinate system (since three points define a circle). The center of the wellbore may then be processed in combination with the center of the tool $C_T$ to determine the eccentering vector $\vec{e}$ (including the eccentering distance and center offset direction). The distance between any one of the extended pads and $C_H$ defines the radius (and therefore the diameter) of the wellbore. This process may be repeated as the tool rotates in the wellbore. The extended pad positions trace out the cross-sectional profile (shape) of the wellbore while rotating which enables the true cross-sectional shape of the wellbore to be reconstructed. The shape of the wellbore may be compared with a circle to determine the degree of ellipticity of the wellbore or any other measure of circular deviation.

The eccentering vector or distance may also be determined in embodiments in which pad extension measurements are only made at a single pad (e.g., at only one of the three pads depicted on FIG. 6-1). FIG. 6-2 depicts a cross-sectional schematic similar to that shown on FIG. 6-1. In the method of FIG. 5, pad extension measurements are made at 104 while rotating the drilling tool 50 in the wellbore at 102. The eccentering distance ecc may be computed from the maximum and/or the minimum pad extension during each tool rotation (or the average maximum and/or the average minimum pad extension over a plurality of rotations), for example, as follows:

$$ecc = PE_{max} - R_\Delta \tag{3}$$

$$ecc = R_\Delta - PE_{min}$$

$$ecc = \frac{PE_{max} - PE_{min}}{2}$$

where $R_\Delta$ represents the difference between the hole radius and the tool radius (i.e., $R_\Delta = R_H - R_T$) and may be taken, for example, to be the difference between the bit radius and the tool radius and $PE_{max}$ and $PE_{min}$ represent the maximum and minimum extensions (maximum and minimum radial displacements) of the pad during a rotation.

An aspect of some embodiments is computing the eccentering distance along a particular azimuthal orientation (i.e., at a particular or predefined toolface angle). For example, in a drilling operation in which the wellbore is intended to turn toward a desired toolface angle, it may be desirable to compute the eccentering distance in that particular direction (or the projection of the eccentering distance along that particular direction). This may be expressed mathematically, for example, as follows:

$$ecc = \frac{|PE(TF_d) - PE(180 - TF_d)|}{2} \tag{4}$$

$$ecc = \frac{PE_{max} - PE_{min}}{2} \cdot \cos|TF_m - TF_d|$$

where $PE(TF_d)$ represents the pad extension (radial displacement) when the pad is rotated in alignment with the desired toolface angle $TF_d$, $PE(180-TF_d)$ represents the pad extension (radial displacement) in the opposite direction (i.e., 180 degrees away from the desired toolface angle), and $TF_m$ represents the measured toolface angle at the maximum extension (radial displacement) of the pad $PE_{max}$.

Figure 7:
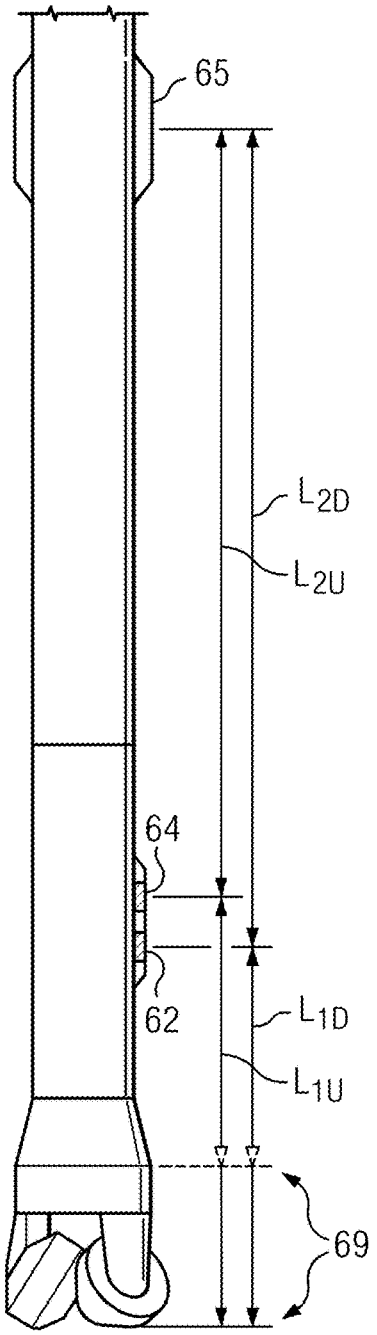
FIG. 7 is a side view of an example lower BHA portion of a drill string, according to embodiments of the present disclosure.

Turning now to FIG. 7, and with continued reference to FIG. 5 and Equation 1, $L_1$ and $L_2$ may be defined by the BHA configuration. As noted above, $L_1$ represents the axial distance (along the length of the BHA) between the drill bit 32 and the pad 60 while $L_2$ represents the axial distance between the pad 60 and the next contact point in the drill string uphole from the pad (e.g., at a fixed stabilizer 65). In one example embodiment (as depicted), the steering tool includes at least first and second axially spaced pads 62 and 64, thereby defining $L_1$ and $L_2$ values for each of the pads (depicted $L_{1D}$ and $L_{2D}$ for the downhole pad and $L_{1U}$ and $L_{2U}$ for the uphole pad). As discussed above with respect to Equation 1, the starting point for measuring $L_1$ (depicted at 69) may be the cutting structure of the bit or a lateral gauge surface of the bit depending on the configuration of the drill bit and the properties of the formation. For instance, the starting point for measuring $L_1$ may be the uphole-most gauge cutter or backreaming cutter on a drill bit. The precise location on the pads 62 and 64 and the fixed stabilizer 65 from which $L_1$ and $L_2$ are measured may also depend on details of the drilling operation. For instance, in FIG. 7, measurements are made to the center of the pads 62 and 64 and stabilizer 65, but measurements may instead be made to other points (e.g., downhole or uphole-most position, center of contact surface, etc.)

Figure 8:
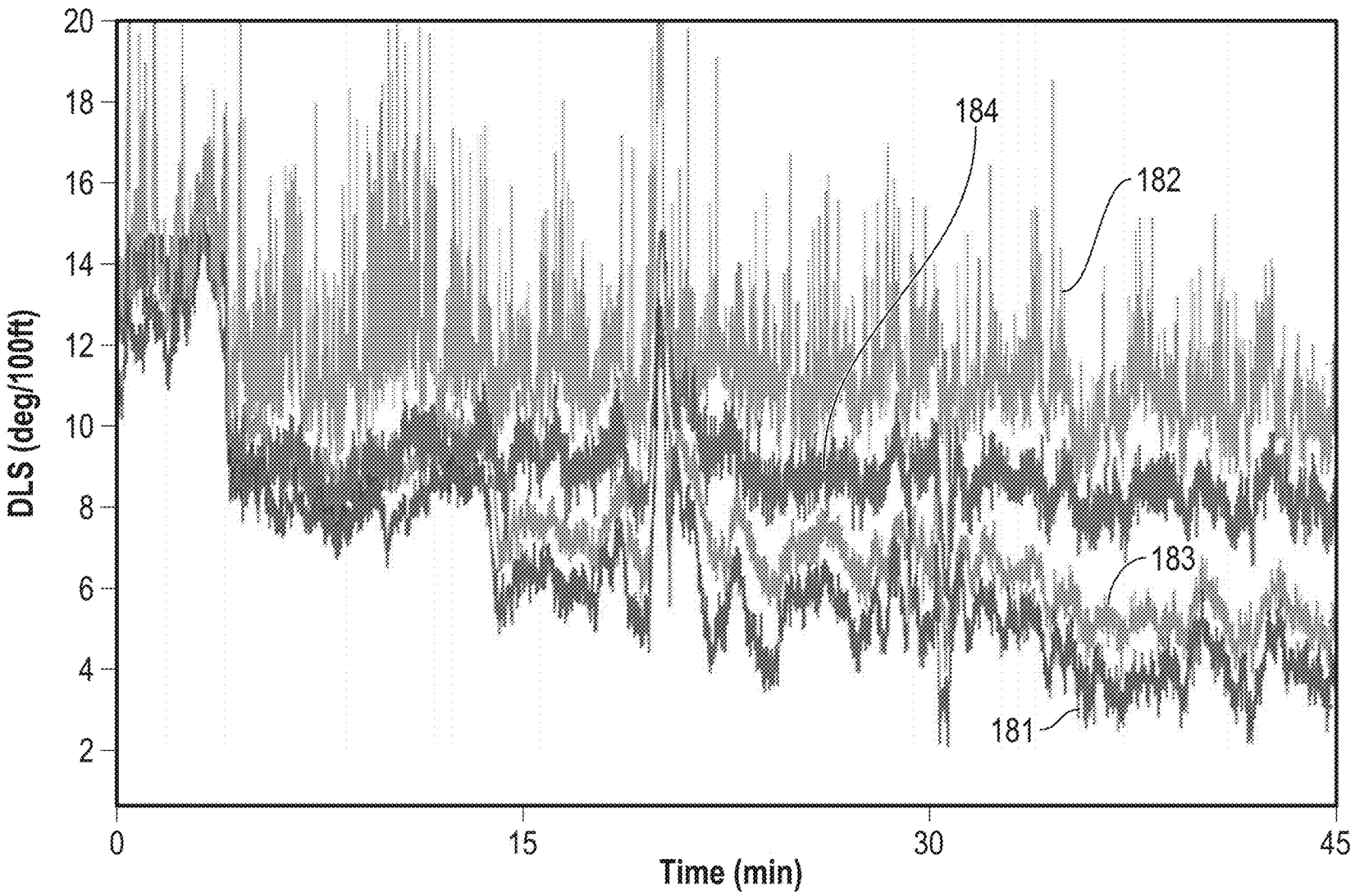
FIG. 8 is a plot of dogleg severity versus drilling time for an example drilling operation, according to embodiments of the present disclosure.

FIG. 8 depicts a plot of DLS versus drilling time for an example drilling operation. The DLS values were obtained using method 100 in FIG. 5. In this example, radial displacement measurements were made using a steering tool configured as described above in FIG. 2 (i.e., including first and second axially spaced sets of circumferentially spaced pads). Maximum and minimum radial displacement measurements were made every full rotation of the tool and were used to compute the eccentering distance (as described above with respect to FIG. 6-2 and Equation 3). The wellbore radius was assumed to be equal to the radius of the drill bit and the tool radius was taken to be the tool radius with the pads fully retracted. The DLS values were computed using Equations 1 and 2 as described above.

In this example four independent DLS values were computed, with first and second measurements 181 and 182 using maximum and minimum extension of the downhole pad and third and fourth measurements 183 and 184 using the maximum and minimum extension of the uphole pad. These independent DLS values showed the same trends but had different absolute values. The DLS values computed from the minimum pad extension measurements were found to have a higher magnitude and higher rotation to rotation scatter (which may be thought of as noise). To reduce the scatter, averaging over several tool rotations may be employed with the minimum pad extension measurements. The DLS values computed from the maximum pad extension measurements tracked one another closely with the uphole pad (the pad further from the bit) giving moderately higher DLS values.

Figure 9:
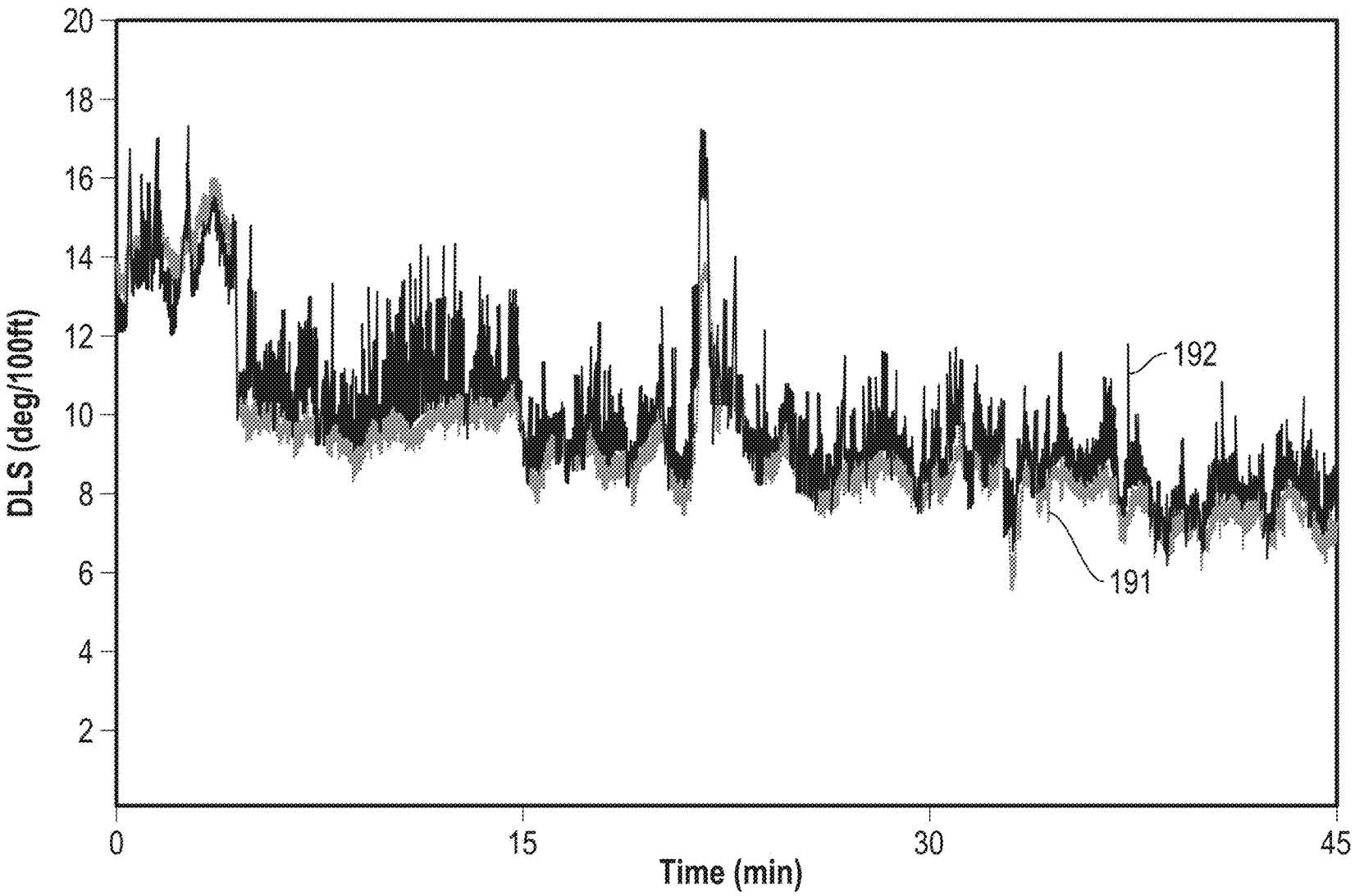
FIG. 9 is another plot of dogleg severity versus drilling time for the same example drilling operation used for the plot of FIG. 8.

FIG. 9 depicts a plot of DLS versus drilling time for the same example drilling operation described above with respect to FIG. 8. The DLS values were obtained from the same maximum radial displacement measurements as used to compute the DLS values shown on FIG. 8 resulting in a first measurement 191 obtained using the downhole pad and a second measurement 192 obtained using the uphole pad. In this example, the pad extension measurements were first used as a wellbore caliper to compute wellbore radius (or diameter) as described above with respect to FIGS. 6-1 and 6-2. The measured wellbore radius was then used in combination with the known tool radius to compute the eccentering distance, which was in turn used to compute the depicted DLS values (which may be thought of as gauge corrected values).

As corrected (and as depicted in FIG. 9), the DLS values change slightly (as can be seen by comparing FIGS. 8 and 9) and have less separation between the uphole and downhole calculated values. Moreover, the DLS values obtained using the downhole piston were observed in this example to have more scatter, possibly owing to greater susceptibility to bit dynamics/hole cleaning effects (due to the closer proximity to the bit) along with the overall displacement being less owing to the smaller $L_1$ value.

Figure 10:
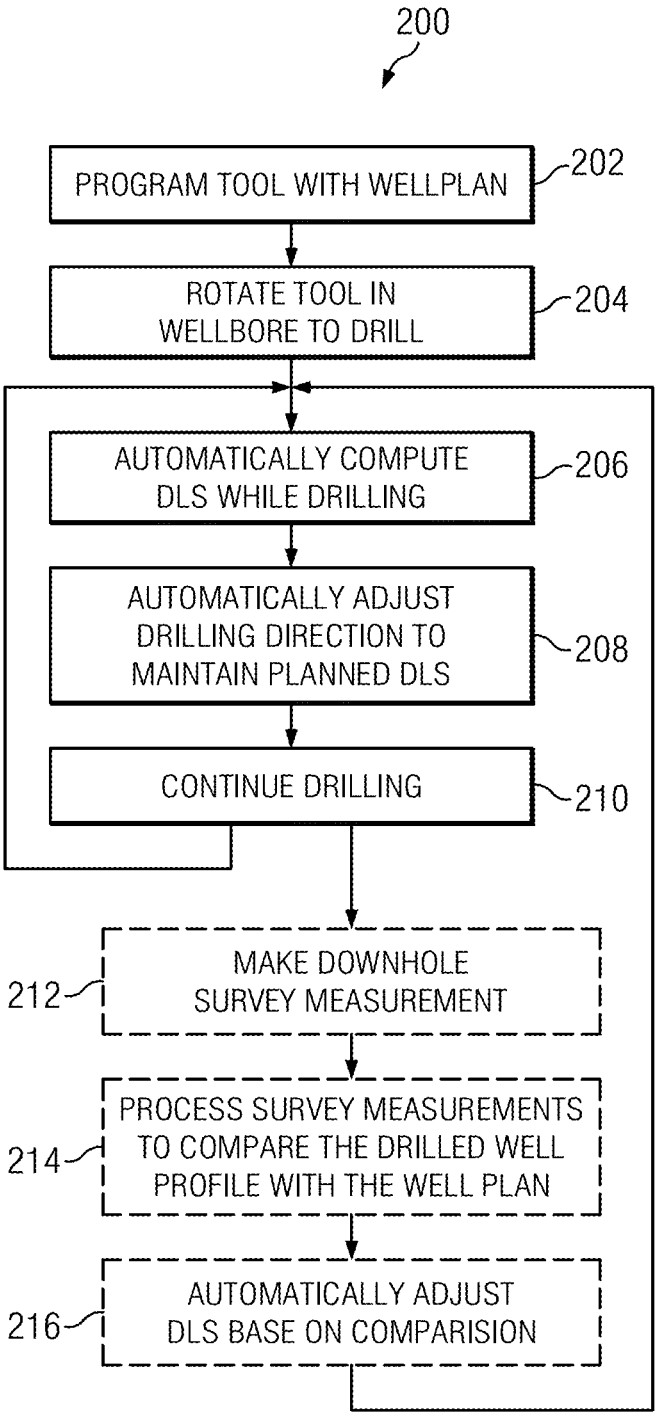
FIG. 10 is a flow chart of an example method for drilling a subterranean wellbore, according to another embodiment of the present disclosure.

Turning now to FIG. 10, a flow chart of one example embodiment of a closed loop method 200 for drilling a subterranean wellbore is depicted. A drilling tool is programmed with, or receives, a well plan at 202. The well plan may include, for example, the planned location of the well in three-dimensional space from which one or more of the wellbore inclination, wellbore azimuth, or dogleg severity may be determined at any depth along the planned wellbore. The well plan may further include at least one section having a predefined curvature. The tool is deployed in the wellbore and drills (e.g., via rotation of the drill string) at 204. The tool automatically and continuously computes DLS while drilling at 206, for example, as described above with respect to FIGS. 5-9 and method 100. The tool may further compute the rate of penetration while drilling at 206, for example, using the methodology disclosed in commonly assigned International Patent Application No. PCT/US2020/064107, which is incorporated herein by this reference in its entirety.

The tool compares the DLS measured in 206 with a DLS from the well plan and adjusts the drilling direction at 208 to steer the drilling along direction of the programmed well plan. The drilling direction may be steered by adjusting the extension and retraction of the pads while the tool rotates in the wellbore. The method continually repeats 206 and 208 (e.g., every second, every few seconds, every minute, or every drilling cycle, depending, for example, on the degree of averaging employed) while drilling at 210 to steer the wellbore along the direction of the well plan.

Method 200 may further optionally includes making downhole survey measurements at 212 (e.g., inclination and azimuth measurements using downhole accelerometer and magnetometer sets as known to those of ordinary skill). These measurements may be either static or continuous. The tool may further process the survey measurements at 214 to compare the overall drilling direction in 210 to the well plan (e.g., to provide a quality control check of the drilled well profile with the well plan). The well plan DLS may then be adjusted at 216 based on the comparison in 214, for example, to adjust for any discrepancy between the surveyed drilling direction and the well plan.

With further reference to FIGS. 5-10, it will be understood that the parameters computed in methods 100 and 200 (e.g., the measured curvature values of the wellbore) may be stored in downhole memory and/or transmitted to the surface, for example, via mud pulse telemetry, electromagnetic telemetry, or other telemetry techniques. With still further reference to FIGS. 5-10, the computed parameters may be further used in controlling the drilling process. For example, pad extension may be automatically controlled to steer the drill bit in response to the continuous wellbore curvature measurements, the survey measurements, or a combination of wellbore curvature and survey measurements.

It will be appreciated that the methods described herein may be configured for implementation via one or more controllers deployed downhole (e.g., in a rotary steerable tool). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 5-10. A suitable controller may also optionally include other controllable components, such as sensors (e.g., a temperature or pressure sensor), data storage devices, power supplies, timers, and the like. The controller may also be in electronic communication with the accelerometers and magnetometers. A suitable controller may also optionally communicate with other instruments in the drill string, such as, for example, telemetry systems that communicate with the surface, measurement-while-drilling tools, logging-while-drilling tools, sensor subs, or other tools. A suitable controller may further optionally include volatile or non-volatile memory or a data storage device.

It will be understood that this disclosure may include numerous embodiments. These embodiments include, but are not limited to, the following embodiments.

A first embodiment may include a method of measuring a curvature of a subterranean wellbore. The method may include: (a) rotating a drill string in the subterranean wellbore, with the drill string including a rotary steering tool (such as a rotary steerable tool or steerable drill bit) and including at least one pad configured to extend radially outward from a tool body and engage a wall of the wellbore, with the engagement operative to steer the drill string in a drilling direction while drilling; (b) measuring radial displacements of the at least one pad while rotating in (a); and (c) processing the radial displacements measured in (b) and computing a curvature of the wellbore while rotating in (a).

A second embodiment may include the first embodiment, and further includes: (d) changing a radial displacement of the pad while rotating in (a) to change the drilling direction in response to the curvature computed in (c).

A third embodiment may include the first or second embodiment, and further includes: (e) continuously repeating (b), (c), and optionally (d) while rotating in (a) to drill a curved section of the wellbore along a well path having a predetermined curvature.

A fourth embodiment may include the first embodiment, and further includes: (d) continuously repeating (b) and (c) while rotating in (a) to compute a plurality of instantaneous curvature values at a time interval of less than 180 seconds, 120 seconds, 60 seconds, 30 seconds, 10 seconds, or 5 seconds.

A fifth embodiment may include any one of the first four embodiments, with (c) further including: (i) processing the radial displacements measured in (b) to compute an eccentering distance of the rotary steerable tool or the steerable drill bit in the wellbore; and (ii) processing the eccentering distance to compute the curvature of the wellbore.

A sixth embodiment may include the fifth embodiment, with the eccentering distance computed in (i) using at least one of the following mathematical equations:

$$ecc = PE_{max} - R_{\Delta}$$

$$ecc = R_{\Delta} - PE_{min}$$

$$ecc = \frac{PE_{max} - PE_{min}}{2}$$

where ecc represents the eccentering distance, $R_{\Delta}$ represents a difference between a radius of the wellbore and a radius of the rotary steerable tool, and $PE_{max}$ and $PE_{min}$ represent maximum and minimum radial displacements of the pad during a rotation.

A seventh embodiment may include any one of the fifth or sixth embodiments, with the curvature computed in (ii) using the following mathematical equation:

$$\frac{1}{R} = \frac{2 \cdot ecc}{L_1 \cdot L_2}$$

where R represents a radius of curvature of the wellbore, ecc represents the eccentering distance, $L_1$ represents an axial distance from the drill bit to the pad, and $L_2$ represents an axial distance from the pad to a closest contact point above the pad.

An eighth embodiment may include any one of the fifth through the seventh embodiments, where (i) further includes: (ia) processing the radial displacements measured in (b) to compute a radius of the wellbore; and (ib) processing the radius of the wellbore and at least one of a maximum radial displacement and a minimum radial displacement of the radial displacements to compute the eccentering distance.

A ninth embodiment may include any one of the fifth through the eighth embodiments, where the eccentering distance is computed in (i) along a predefined toolface angle that represents a direction in which the wellbore is intended to turn during drilling in (a).

A tenth embodiment may include the ninth embodiment, where the eccentering distance is computed in (i) using at least one of the following mathematical equations:

$$ecc = \frac{|PE(TF_d) - PE(180 - TF_d)|}{2}$$

$$ecc = \frac{PE_{max} - PE_{min}}{2} \cdot \cos|TF_m - TF_d|$$

where ecc represents the eccentering distance, $PE(TF_d)$ represents the radial displacement in the direction of the predefined toolface angle $TF_d$, $PE(180-TF_d)$ represents the radial displacement in a direction 180 degrees opposed to the predefined toolface angle, and $TF_m$ represents a measured toolface angle at the maximum radial displacement of the pad $PE_{max}$.

An eleventh embodiment may include any one of the first ten embodiments, where the rotary steering tool includes at least first and second, downhole and uphole, axially spaced pads arranged and designed to move and extend radially outwardly from the tool body and engage the wall of the wellbore.

A twelfth embodiment may include the eleventh embodiment, where (c) includes processing the radial displacements measured in (b) to compute a plurality of independent curvature measurements of the wellbore while drilling in (a), the plurality of measurements selected from the group consisting of a first measurement using a maximum radial displacement of the downhole pad, a second measurement using a minimum radial displacement of the downhole pad, a third measurement using a maximum radial displacement of the uphole pad, and a fourth measurement using a minimum radial displacement of the uphole pad.

A thirteenth embodiment may include the eleventh or twelfth embodiment, where the first and second pads have an axial spacing of less than about 30 centimeters; and at least one of the first and second pads is deployed less than 1.5 meters above the cutting structure of a drill bit.

A fourteenth embodiment includes a closed loop method for drilling a wellbore along a predefined curve. The method includes: (a) programming a rotary steering tool with a well plan, the well plan including a predefined curve, the rotary steering tool including at least one pad configured to extend radially outward from a tool body and engage a wall of the wellbore; (b) rotating the rotary steering tool in a wellbore to drill; (c) measuring radial displacements of the pad while drilling in (b); (d) processing the radial displacements measured in (c) to compute a curvature of the wellbore while drilling in (b); (e) automatically adjusting a radial displacement of the pad to maintain a direction of drilling along the well plan in response to a comparison of the curvature measured in (d) and a curvature of the predefined curve; and (f) continually repeating (c), (d), and (e) while drilling in (b).

A fifteenth embodiment may include the fourteenth embodiment, and further including: (g) making a downhole survey measurement; (h) processing the survey measurement to compare a profile of the wellbore drilled in (b) with the well plan; and (i) automatically adjusting a dogleg severity of the predefined curve in response to the comparison in (h).

A sixteenth embodiment includes a system for drilling a subterranean wellbore. The system includes a rotary steering tool including: at least first and second axially spaced pads configured to extend radially outwardly from a tool body and engage a wall of the wellbore, the engagement operative to steer a drilling direction; and a downhole controller in the rotary steering tool, the controller including instructions to (i) measure radial displacements of each of the first and second axially spaced pads while the system rotates in the wellbore and (ii) process the radial displacements measured in (i) to compute a curvature of the wellbore while drilling.

A seventeenth embodiment may include any of the first through sixteenth embodiment, where the rotary steering tool includes a rotary steerable tool coupled to a drill bit, or includes a steerable drill bit.

Although estimation of wellbore curvature using pad displacement measurements and certain aspects thereof have been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

All numerical values or relationships include values or relationships that are "approximately," "about," or "substantially" the same, and include an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A method for measuring a curvature of a subterranean wellbore, the method comprising:

(a) rotating a drill string in the subterranean wellbore, the drill string including a rotary steering tool including at least one pad arranged and designed to extend radially outward from a tool body and engage a wall of the subterranean wellbore, the engagement operative to steer the drill string in a drilling direction;

(b) measuring radial displacements of the at least one pad while rotating in (a);

(c) computing an eccentering distance of the rotary steering tool in the subterranean wellbore while rotating in (a) by processing the radial displacements measured in (b);

(d) computing a curvature of the subterranean wellbore while rotating in (a) by processing the eccentering distance computed in (c); and (e) changing radial displacement of the at least one pad while rotating in (a) to change the drilling direction in response to the curvature computed in (d).

2. The method of claim 1, further comprising:

(f) continuously repeating (b), (c), (d), and (e) while rotating in (a) while drilling a curved section of the subterranean wellbore along a well path having a predetermined curvature.

3. The method of claim 1, further comprising:

(f) computing a plurality of instantaneous curvature values by continuously repeating (b) and (c) and (d) while rotating in (a).

4. The method of claim 1, wherein the eccentering distance is computed in (c) using at least one of the following mathematical equations:

$$ecc = PE_{max} - R_{\Delta}$$

$$ecc = R_{\Delta} - PE_{min}$$

wherein ecc represents the eccentering distance, $R_{\Delta}$ represents a difference between a radius of the subterranean wellbore and a radius of the rotary steering tool, and $PE_{max}$ and $PE_{min}$ represent maximum and minimum radial displacements of the at least one pad during a rotation.

5. The method of claim 1, wherein the curvature is computed in (d) using the following mathematical equation:

$$\frac{1}{R} = \frac{2 \cdot ecc}{L_1 \cdot L_2}$$

wherein R represents a radius of curvature of the subterranean wellbore, ecc represents the eccentering distance, $L_1$ represents an axial distance from a drill bit to the at least one pad, and $L_2$ represents an axial distance from the at least one pad to a closest contact point above the pad.

6. The method of claim 1, wherein (c) further comprises:

(ca) computing a radius of the subterranean wellbore by processing the radial displacements measured in (b); and (cb) computing the eccentering distance by processing the radius of the subterranean wellbore and at least one of a maximum radial displacement or a minimum radial displacement of the radial displacements.

7. The method of claim 1, wherein the eccentering distance is computed in (c) along a predefined toolface angle that represents a direction in which the subterranean wellbore is intended to turn during drilling in (a).

8. The method of claim 7, wherein the eccentering distance is computed in (c) using at least one of the following mathematical equations:

$$ecc = \frac{|PE(TF_d) - PE(180 - TF_d)|}{2}$$

$$ecc = \frac{PE_{max} - PE_{min}}{2} \cdot \cos|TF_m - TF_d|$$

wherein ecc represents the eccentering distance, $PE(TF_d)$ represents the radial displacement in the direction of a predefined toolface angle $TF_d$, $PE(180-TF_d)$ represents the radial displacement in a direction 180 degrees opposed to the predefined toolface angle $TE_d$, and $TF_m$ represents a measured toolface angle at the maximum radial displacement $PE_{max}$ of the at least one pad during a rotation, and $PE_{min}$ represents minimum radial displacement of the at least one pad during a rotation.

9. The method of claim 1, wherein the rotary steering tool includes at least first and second, downhole and uphole, axially spaced pads arranged and designed to extend radially outwardly from the tool body and engage the wall of the subterranean wellbore.

10. The method of claim 9, wherein (d) comprises computing a plurality of independent curvatures of the subterranean wellbore while rotating in (a) by processing a plurality of eccentering distances computed in (c), wherein the plurality of eccentering distances computed in (c) are derived from at least one of maximum radial displacement of the downhole pad, minimum radial displacement of the downhole pad, maximum radial displacement of the uphole pad, or minimum radial displacement of the uphole pad.

11. The method of claim 9, wherein:

the first and second pads have an axial spacing of less than 30 cm therebetween; and at least one of the first or second pads is deployed less than 1.5 meters above a cutting structure of cutting surface of a drill bit of the rotary steering tool or the drill string.

12. The method of claim 1, wherein the rotary steering tool is a steerable drill bit or a rotary steerable tool coupled to a drill bit.

13. A closed loop method for drilling a wellbore along a predefined curve, the method comprising:

(a) programming a rotary steering tool with a well plan, the well plan including a predefined curve, the rotary steering tool including at least one pad arranged and designed to extend radially outward from a tool body of the rotary steering tool and engage a wall of the wellbore;

(b) rotating the rotary steering tool in a wellbore while drilling;

(c) measuring radial displacements of the at least one pad while drilling in (b);

(d) computing an eccentering distance of the rotary steering tool in the subterranean wellbore while drilling in (b) by processing the radial displacements measured in (c);

(e) computing a curvature of the wellbore while drilling in (b) by processing the eccentering distance computed in (d);

(f) automatically adjusting a radial displacement of the at least one pad to maintain a direction of drilling along the well plan in response to a comparison of the curvature computed in (e) and a curvature of the predefined curve; and (g) continually repeating (c), (d), (e), and (f) while drilling in (b).

14. The method of claim 13, further comprising:

(h) making a downhole survey measurement;

(i) comparing a profile of the wellbore drilled in (b) with the well plan by processing the survey measurement; and (j) automatically adjusting a dogleg severity of the predefined curve in response to the comparison in (i).

15. The method of claim 13, wherein the rotary steering tool is a steerable drill bit or a rotary steerable tool coupled to a drill bit.

16. A system for drilling a subterranean wellbore, the system comprising:

a rotary steering tool including at least first and second axially spaced pads arranged and designed to extend radially outward from a tool body and engage a wall of the subterranean wellbore and thereby steer the rotary steering tool in a drilling direction; and a downhole controller coupled to the rotary steering tool, the controller including instructions arranged and designed to cause the downhole controller to:

(i) measure radial displacements of each of the first and second axially spaced pads while the system rotates in the subterranean wellbore, (ii) compute an eccentering distance of the rotary steering tool in the subterranean wellbore while the system rotates in the subterranean wellbore by processing the radial displacements measured in (i), iii) compute a curvature of the subterranean wellbore while the system rotates in the subterranean wellbore by processing the eccentering distance computed in (ii), and iv) automatically adjust radial displacement of the at least one pad by processing the curvature of the subterranean wellbore computed in iii) while the system rotates in the subterranean wellbore.

17. The system of claim 16, wherein the rotary steering tool is a steerable drill bit or a rotary steerable tool coupled to a drill bit.

18. The system of claim 16, further comprising one or more sensors arranged and designed to measure the radial displacement of the first and second axially spaced pads, wherein the instructions are arranged and designed to cause the downhole controller to measure the radial displacements in (i) by communicating with the one or more sensors.

* * * * *